US005263609A

United States Patent [19]

Hoshino

[11] Patent Number: 5,263,609

[45] Date of Patent: Nov. 23, 1993

[54] DISPOSABLE CONTAINER

[75] Inventor: Takahiro Hoshino, Yokohama, Japan

[73] Assignee: Toyo Bussan Co. Ltd., Tokyo, Japan

[21] Appl. No.: 822,315

[22] Filed: Jan. 17, 1992

[30] Foreign Application Priority Data

Jan. 21, 1991 [JP] Japan ..... 3-019109

[51] Int. Cl.[5] ..... B65D 37/00

[52] U.S. Cl. ..... 222/92; 222/541

[58] Field of Search ..... 222/92, 107, 541, 94; 206/484, 530, 531, 532; 420/115

[56] References Cited

U.S. PATENT DOCUMENTS

| | | | |
|---|---|---|---|
| 2,707,581 | 5/1955 | Kaplan et al. | 222/107 |
| 3,777,949 | 12/1973 | Chiquiari-Arias | 222/541 |
| 3,964,604 | 6/1976 | Prenntzell | 206/219 |
| 4,136,678 | 1/1979 | Beach | 222/94 |
| 4,759,472 | 7/1988 | Strenger | 222/92 |
| 4,872,556 | 10/1989 | Farmer | 222/94 |
| 4,890,744 | 1/1990 | Lane, Jr. et al. | 222/92 |
| 4,952,068 | 8/1990 | Flint | 206/219 |
| 4,988,016 | 1/1991 | Hawkins et al. | 222/92 |
| 5,195,658 | 3/1993 | Hoshino | 222/92 |

FOREIGN PATENT DOCUMENTS

| | | | |
|---|---|---|---|
| 2644141 | 9/1990 | France | 222/541 |

*Primary Examiner*—Andres Kashnikow
*Assistant Examiner*—Philippe Derakshani
*Attorney, Agent, or Firm*—Rogers & Killeen

[57] ABSTRACT

A disposable container for a liquid such as soy sauce, detergent or cosmetics, discharges its contents when the container is folded over and pressure is applied to the container by the palm or fingers of the hand. The container includes a sealed portion that has a narrow width and which is formed into a circular, elliptic, rhomboid or other shape in such a manner that the center of the sealed portion coincides with the center line of the container about which the container may be folded. A discharge port is formed in the central portion of the sealed portion or in the side of the container from which the contents are desired to be discharged so that when the container is folded over and pressure applied thereto to rupture the sealed portion, the contents of the containers are discharged through the discharge port.

6 Claims, 7 Drawing Sheets

DISPOSABLE CONTAINER

BACKGROUND OF THE INVENTION

1. Field of the Invention

The present invention relates to a disposable container arranged in such a manner that it encloses a liquid condiment, a liquid detergent, liquid cosmetics, liquid medicine or the like before sealing is performed, and in which the content is discharged when the container is folded over and pressure is applied to the container by the palm or the fingers of the hand.

2. Related Art Statement

Hitherto, an ordinary disposable container of the type described above has been arranged in such a manner that a notch for opening the container is formed in its sealed portion as shown in FIG. 7 so that the content is discharged or taken out by tearing up the container from the above-described notch.

However, a major portion of the conventional containers cannot easily be torn up from the notch, causing the following problems to arise:

(1) The content will undesirably fly out at the time of tearing up the container, causing clothes or the like to be contaminated.

(2) In a case of a container for a food, the broken piece will sometimes undesirably come in the food, causing a problem in terms of salinity to arise.

(3) Clothes can be contaminated by the content sticked to the above-described broken piece.

(4) As a returnable container for accommodating a filler or the like which is used by mixing two or more types of liquids, there is no returnable container having a simple opening structure or a simple outlet structure.

As a container capable of overcoming the above-described problems (1) to (3) and displaying a structure with which opening can easily be performed, a structure has been disclosed in Japanese Patent Laid-Open No. 56-82849. The above-described container is, as shown in FIG. 8, made of flexible sheet material, the peripheral portion of which is sealed up, and arranged in such a manner that it is torn up when the content is taken out, the container being characterized in that the peripheral sealed portion is substantially formed into a V-shape the vertex of which faces inwards. When pressure is applied to the container from outside, the separation first takes place at the vertex of the V-shape seal. The torn-up portion sequentially propagates in a predetermined direction so that the content is caused to be discharged from the container. The trial manufacture and practical tests found a fact that the predetermined portion is not torn up.

That is, the above-described container is arranged in such a manner that pressure is applied to the sealed portion to tear up the V-shaped seal portion. However, the outer line of the sealed portion which discharges the content or from which the content is taken out is arranged to form a V-shape confronting the inside of the container. Therefore, although the vertex of the V-shaped sealed portion can be torn up, the thus-commenced tearing does not propagate along the predetermined route. The longitudinal sealed portion on both sides of the container are undesirably torn up.

Furthermore, it is arranged in such a manner that the sealed portion is torn up with applied pressure so that an opened portion is formed and thereby the content is forcibly discharged. Therefore, the content rapidly flies out through an opened portion formed undesirably immediately after the tear-up opening is formed on the two sides of the sealed portion. Furthermore, another problem arises in that the content cannot easily be discharged to a desired position.

Furthermore, as a disposable container for accommodating a filler or the like which is used by mixing two or more kinds of liquids, there is no disposable container having a simple opening structure or a simple outlet structure.

SUMMARY OF THE INVENTION

Accordingly, an object of the present invention is to provide a nonreturnable container of a type, the opening of which is formed by partially tearing the sealed portion with applied pressure, the disposable container being able to be easily torn by pressure and in which the content does not fly out from the opening formed by the tearing action, that is, the content can be forcibly discharged to a desired position. Furthermore, two kinds of liquids can be accommodated while being insulated from each other and they can be mixed while being simultaneously discharged.

According to an aspect of the present invention, there is provided a nonreturnable container of a type which accommodates a liquid substance before sealing is performed and from which the content is taken out by tearing a sealed portion, the disposable container comprising: a sealed portion having a narrow width and formed into a circular shape, an elliptic shape, or a rhomboid shape the like in such a manner that the sealed portion's center coincides with the center line of the container which halves the container; and a discharge port formed in the central portion of the sealed portion or a discharge port formed in the central portion of a side from which the content in the sealed portion is desired to be discharged, the discharge port being communicated with an outlet port which has been previously formed in the container so that the sealed portion is torn by applying pressure to the container after the container has been folded over to discharge the content through the discharge port.

That is, when the container which accommodates the content is folded over and pressure is applied, the sealed portion is torn from the two end portions to discharge the content through the discharge port. In a case where the sealed portion is formed in the circular shape or the elliptic shape, it is preferable that the two end portions of the sealed portion be formed into nipple-like shapes, that is, small sealed portions formed into projections so that peeling can easily be taken place with pressure. Furthermore, it is preferable that the area of a portion inside the sealed portion be larger than the area of the discharge port in order to decrease the speed at which the content is discharged after the sealed portion has been torn so that undesirable flying of the content through the discharge port is prevented.

According to the present invention, the following materials may be employed: a synthetic resin film having a heat sealing characteristic; a material manufactured by layering a heat sealing synthetic resin on a synthetic film having no heat sealing characteristic; a material manufactured by layering aluminum foil or the like on the above-described material. Furthermore, a material of a type which is sealed by an adhesive agent may be used if desired.

Other and further objects, features and advantages of the invention will be appear more fully from the following description.

DESCRIPTION OF THE PREFERRED EMBODIMENTS

Preferred embodiments of the present invention will now be described with reference to the drawings.

Figure 1A:
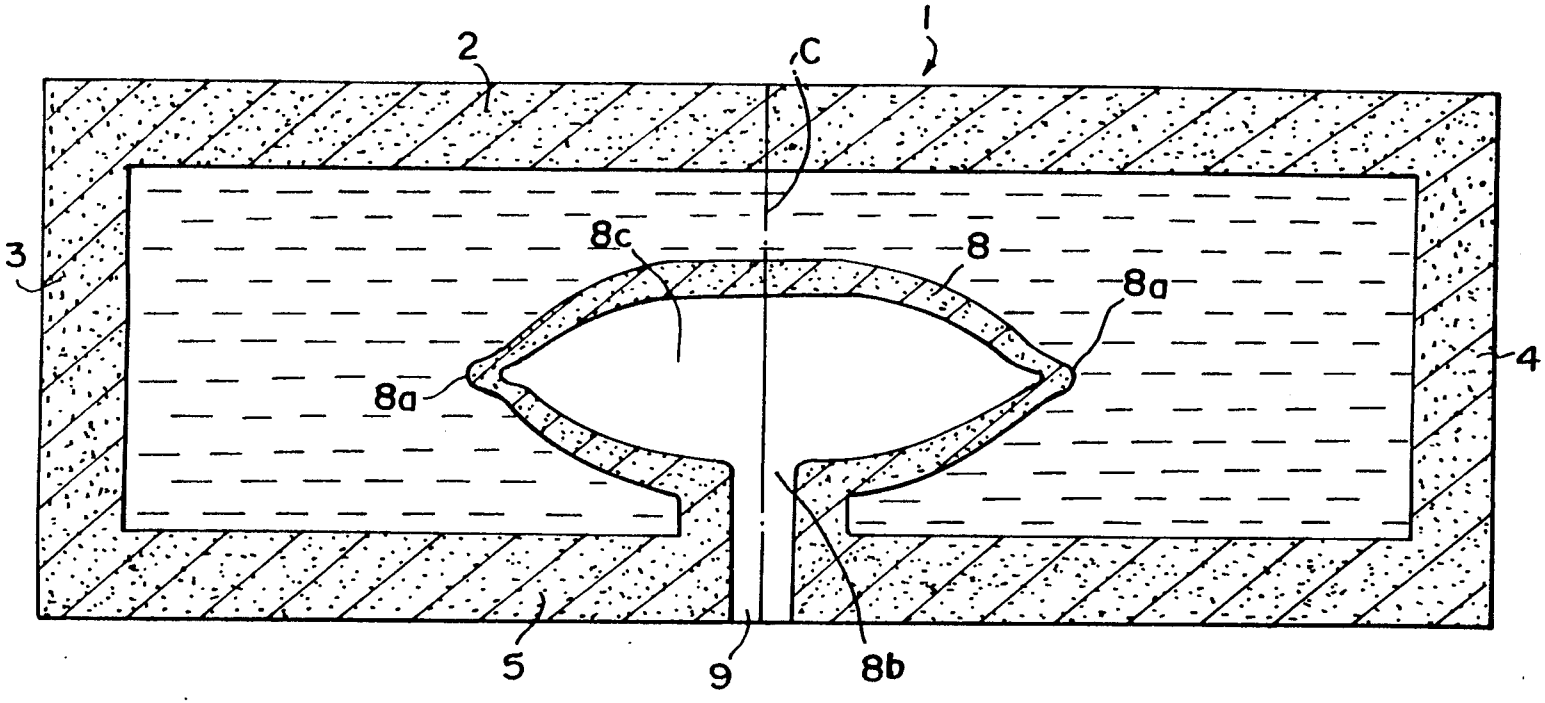
FIG. 1*a* is a plan cross sectional view which illustrates a first example of a first embodiment of the present invention.
Figure 6:
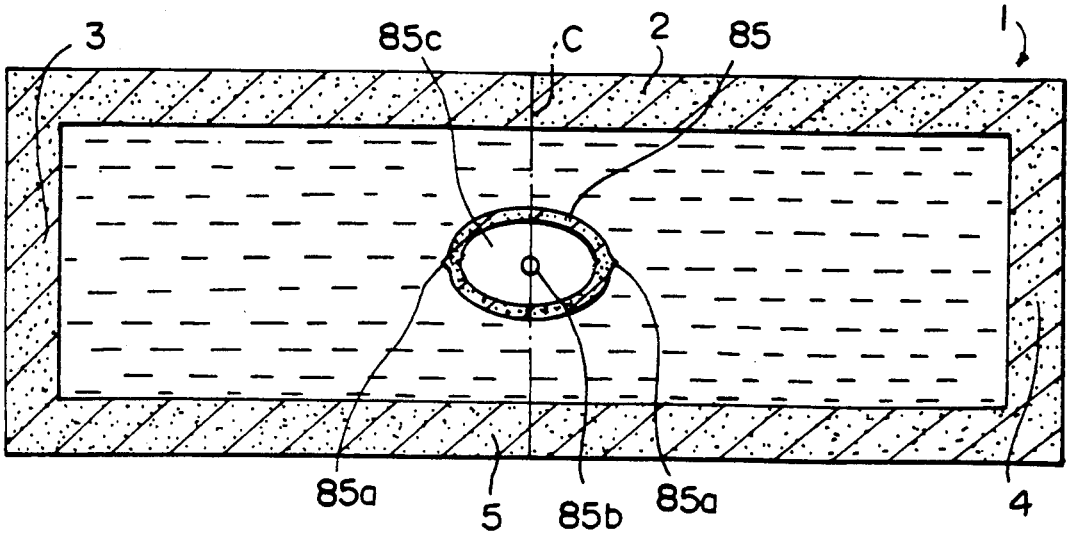
FIG. 6 is a plan cross sectional view which illustrates a sixth embodiment of the present invention.
Figure 7:
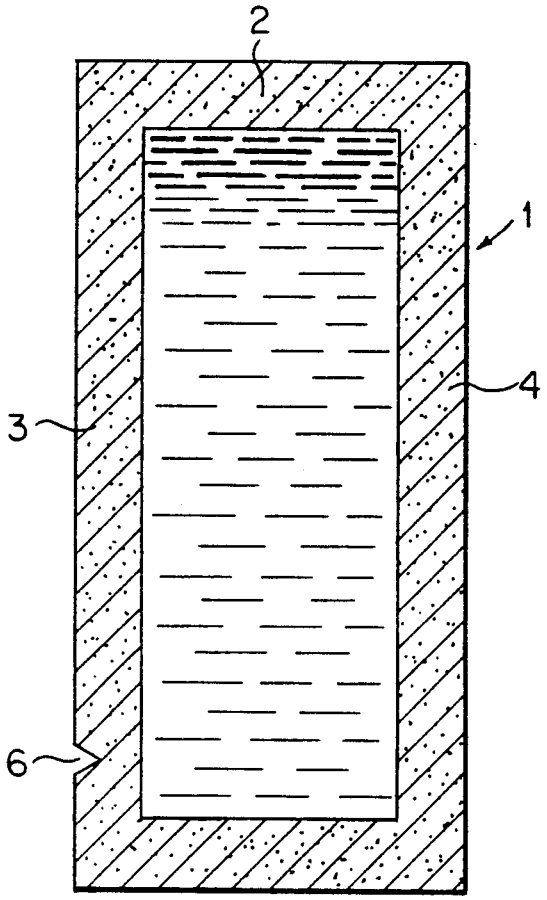
FIG. 7 PRIOR ART
FIG. 7 is a plan cross sectional view which illustrates a conventional container.
Figure 8:
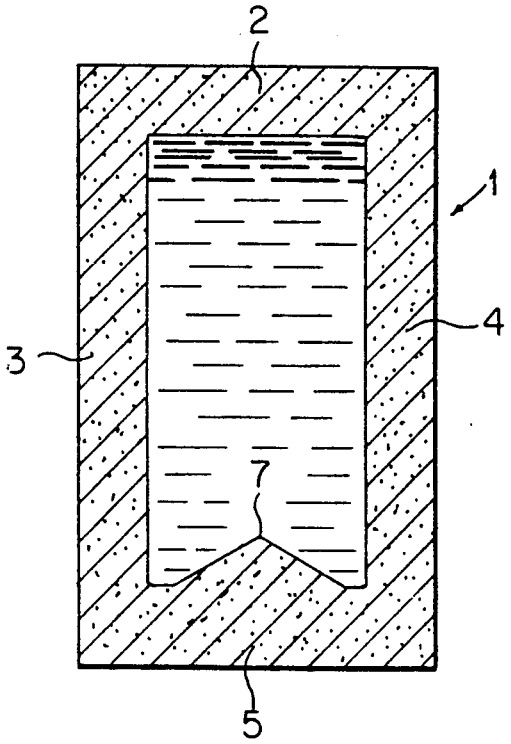
FIG. 8 PRIOR ART
FIG. 8 is a plan cross sectional view which illustrates another conventional container.

Referring to FIGS. 1*a* to 1*c* and FIG. 6, the same reference numerals represent the same elements as those shown in FIGS. 7 and 8. Referring to FIG. 1*a*, reference numeral 8 represents a sealed portion formed into an elliptic shape having a narrow width in such a manner that its center line coincides with center line C of the container 1. The sealed portion 8 is formed in such a manner that its two end portions are formed into nipple-like portions 8*a* and as well as a discharge port 8*b* is formed in its central portion adjacent to a sealed portion 5. Furthermore, the above-described discharge port 8*b* is previously communicated with an outlet port 9. Reference numeral 8*c* represents a space formed in the sealed portion 8, the space 8*c* serving as a deceleration chamber acting to reduce the speed at which the content is discharged.

As a result of the structure thus-constituted, liquid accommodated in the container 1 is discharged when the container 1 is folded over at the above-described center line C and pressure is applied to the container 1. As a result, the two nipple-like portions 8*a* in the sealed portion 8 are torn so that liquid passes through the discharge port 8*b* and the outlet port 9 after the flow rate is decelerated in the deceleration chamber 8*c*. Therefore, the fear of flying of enclosed liquid can be eliminated and as well as the content can be supplied to a target position by directing the outlet port 9 at a desired position.

Figure 1B:
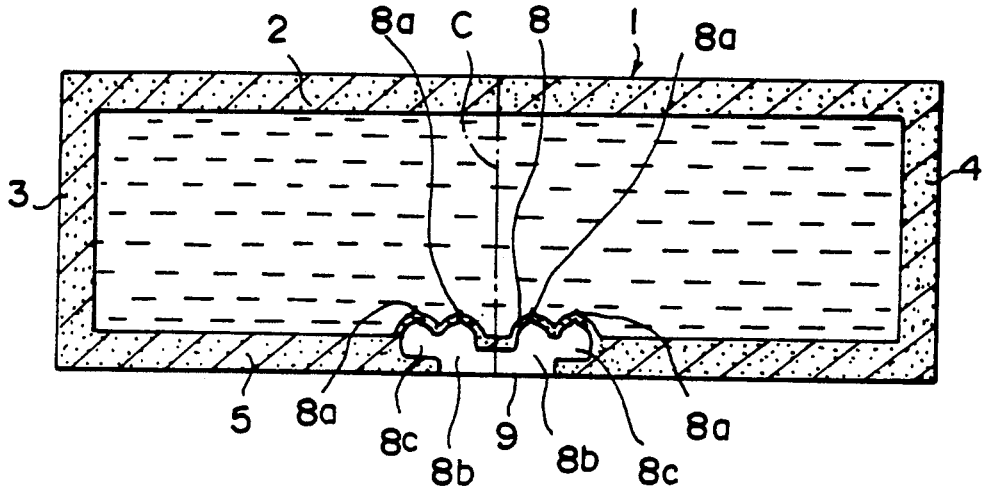
FIG. 1*b* is a plan cross sectional view which illustrates a second example of a first embodiment of the present invention.
Figure 1C:
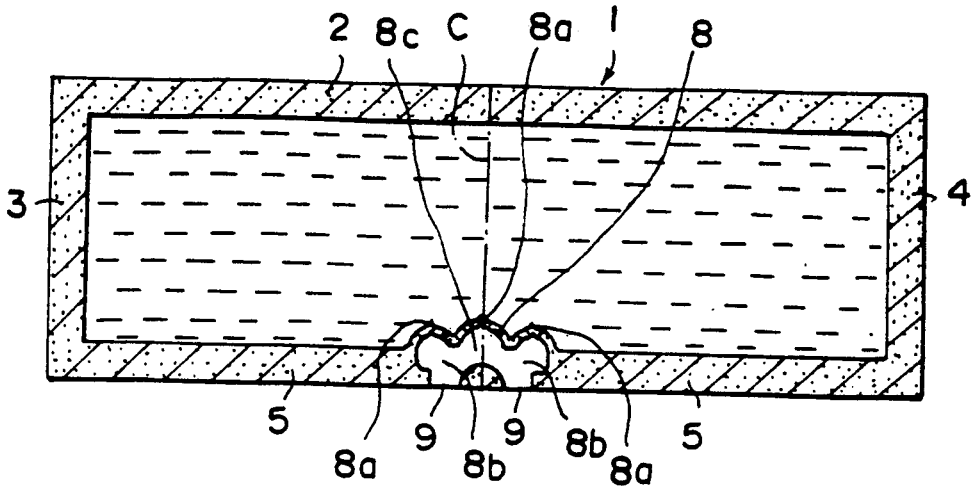
FIG. 1*c* is a plan cross sectional view which illustrates a third example of a first embodiment of the present invention.

FIGS. 1*b* and 1*c* illustrate examples each of which is arranged in such a manner that the sealed portion 8 is formed into projections arranged symmetrically with respect to the center line of the container 1. Referring to FIG. 1*b*, the sealed portion 8 is formed to have four projections, while the sealed portion 8 is formed to have three projections referring to FIG. 1*c*. Each of the containers 1 according to the present invention and respectively shown in FIGS. 1*b* and 1*c* is arranged in such a manner that its sealed portion 8 is opened similarly to that of the container 1 shown in FIG. 1*a*. The top portion of each of the projections of the sealed portion 8 is formed into the nipple-like portion 8*a*.

Figure 2:
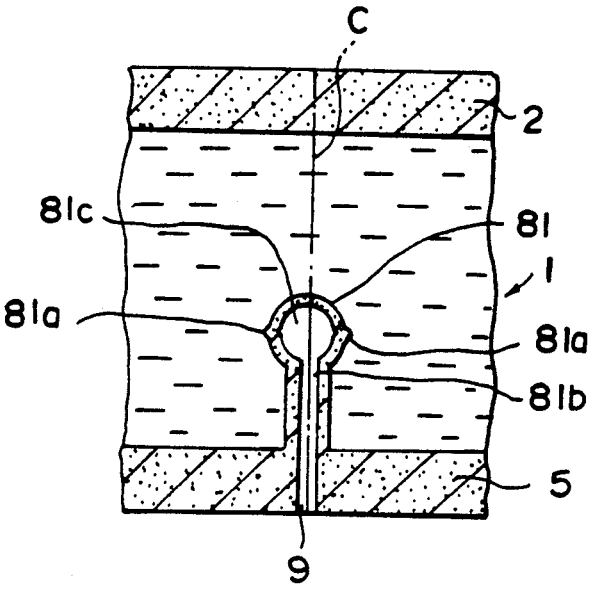
FIG. 2 is a plan cross sectional view which illustrates a second embodiment of the present invention.
Figure 3:
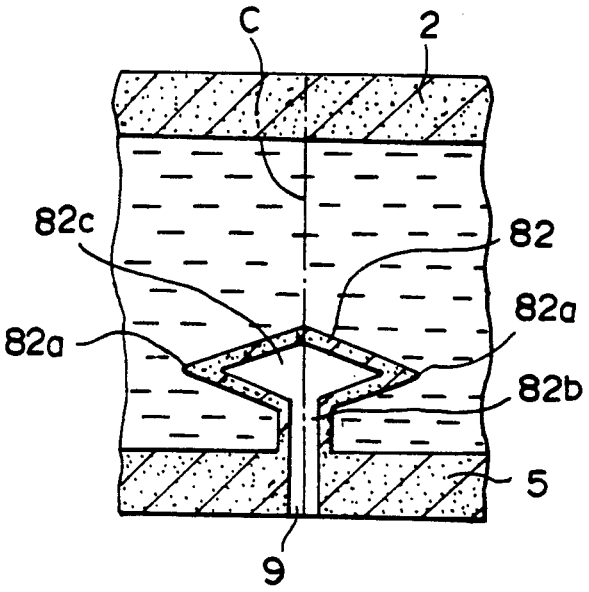
FIG. 3 is a plan cross sectional view which illustrates a third embodiment of the present invention.

FIGS. 2 and 3 illustrate structures each of which is arranged in such a manner that tear-up sealed portion is formed in the container 1 having the sealed portions 2 and 5. A sealed portion 81 shown in FIG. 2 is formed into a circular shape (that is, where the projecting sealed sides have an inverted U-shape) having nipple-like portions 81*a*.

Furthermore, a discharge port 81*b* is formed in the central portion adjacent to the sealed portion 5. The inside portion of the sealed portion 81 is formed into deceleration chamber 81*c*. Furthermore, a sealed portion 82 shown in FIG. 3 is formed in a rhomboid shape elongated horizontally (that is, where the projecting sealed sides have an inverted V-shape). In addition, a discharge port 82*b* is formed in the central portion adjacent to the sealed portion 5 and as well as the inside portion of the sealed portion 82 is formed into a deceleration chamber 82*c*. The above-described elements act as those shown in FIGS. 1*a* to 1*c*. The reason why no nipple-like portion is provided for the sealed portion 82 shown in FIG. 3 lies in that top portions 82*a* formed on the two sides of the sealed portion 82 cause a similar effect to be obtained to that obtainable from the nipple-like portion.

Figure 4:
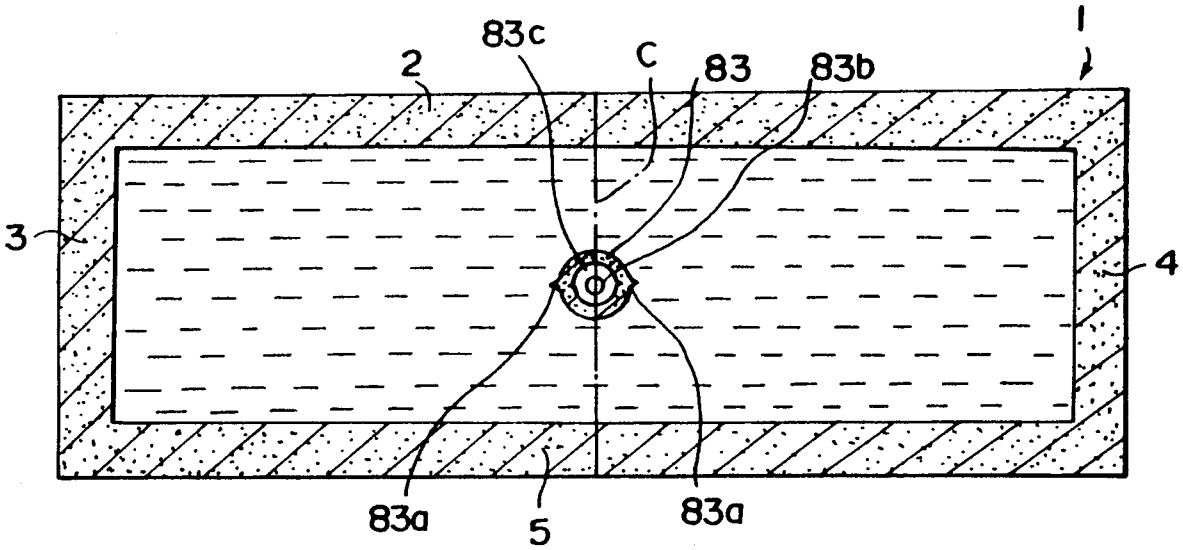
FIG. 4 is a plan cross sectional view which illustrates a fourth embodiment of the present invention.
Figure 5:
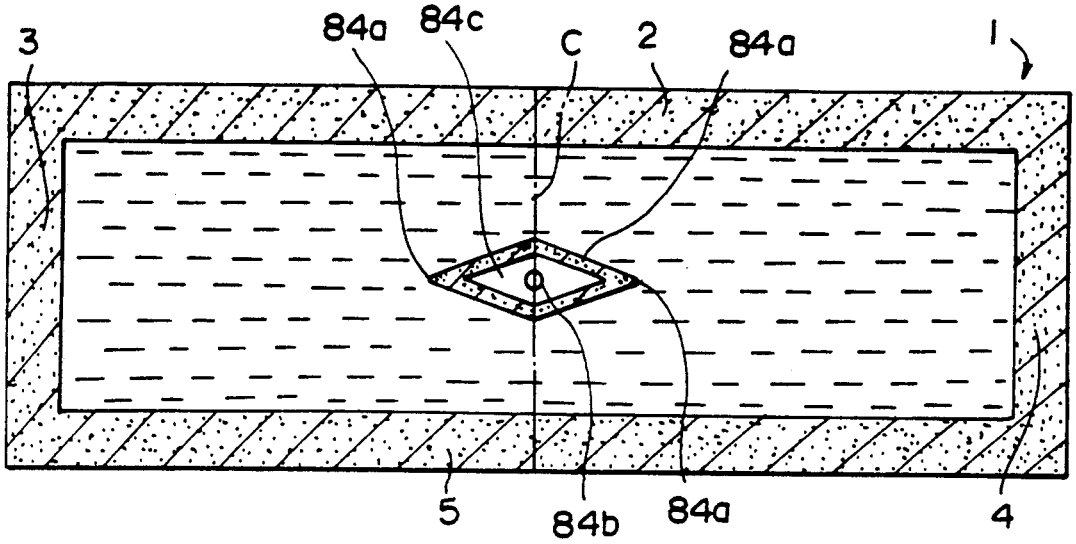
FIG. 5 is a plan cross sectional view which illustrates a fifth embodiment of the present invention.

On the other hand, FIGS. 4 to 6 illustrate structures each of which is arranged similarly to the container shown in FIG. 1 in such a manner that a tear-up sealed portion is formed in the central portion of the container 1 of a type having no discharge port in its sealed portion 5. A sealed portion 83 shown in FIG. 4 is formed into a circular shape and as well as nipple-like portions 83*a* are formed on the two sides of the sealed portion 83. Furthermore, a discharge port 83*b* is formed in the central portion of the sealed portion 83. The inside portion of the sealed portion 83 is formed into a deceleration chamber 83*c*. The structures as shown in FIGS. 5 and 6 are arranged similarly to that shown in FIG. 4 but there is a difference from the same that the shape of the tear-up sealed portion is different. That is, reference numeral 84 represents a sealed portion and 84*a* represent two-end top portions which correspond to the above-described nipple-like portions.

Reference numeral 84*b* represents a discharge port, 84*c* represents a deceleration chamber, 85 represents a sealed portion, 85*a* represent nipple-like portions, 85*b* represents a discharge port and 85*c* represents a deceleration chamber.

Figure 11:
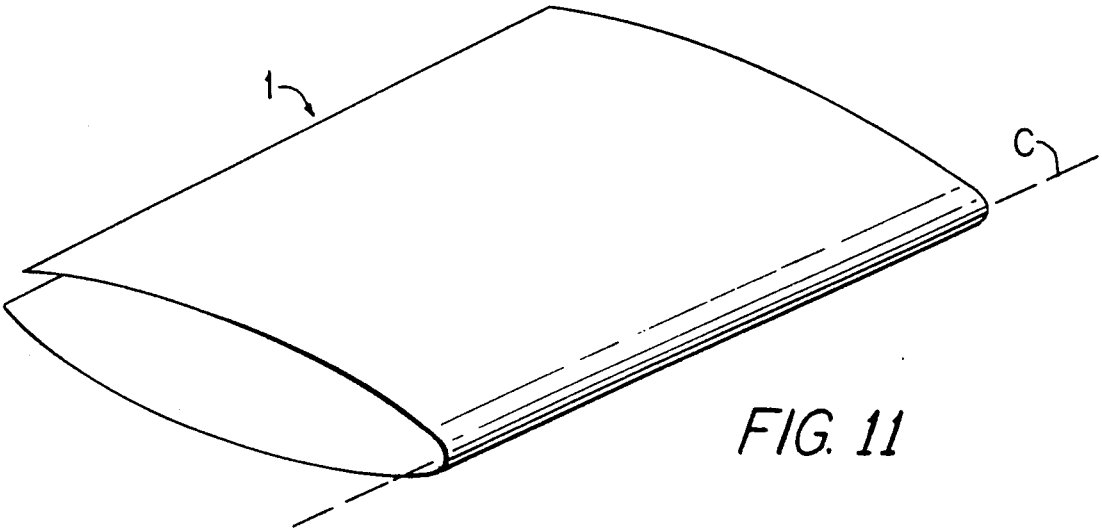
FIG. 11 is a pictorial depiction of the present invention showing the container folded over.

When each of the containers 1 respectively shown in FIGS. 4 to 6 is folded over at its center line C (such as illustrated in FIG. 11) before pressure is applied to the container 1, liquid enclosed in the container 1 strongly presses the outside portion of each of the nipple-like portions 84*a*, 85*a* and the top portion 83*a* of the sealed portion so that peeling takes place. Furthermore, each of the sealed portions 83, 84 and 85 is gradually torn up so that liquid is introduced into each of the deceleration chambers 83*c*, 84*c* and 85*c* before liquid is discharged outside through each of the discharge ports 83*b*, 84*b* and 85*b* formed in the central portion of each of the deceleration chambers 83*c*, 84*c* and 85*c*. However, since the flow rate of liquid enclosed in the container 1 is decelerated in each of the deceleration chambers 83*c*, 84*c* and 85*c*, the fear of flying of liquid through each of the discharge ports 83*b*, 84*b* and 85*b* can be eliminated. Furthermore, by causing each of the discharge ports 83*b*, 84*b* and 85*b* to aim at a desired position, the content can be supplied to a desired place.

Figure 9:
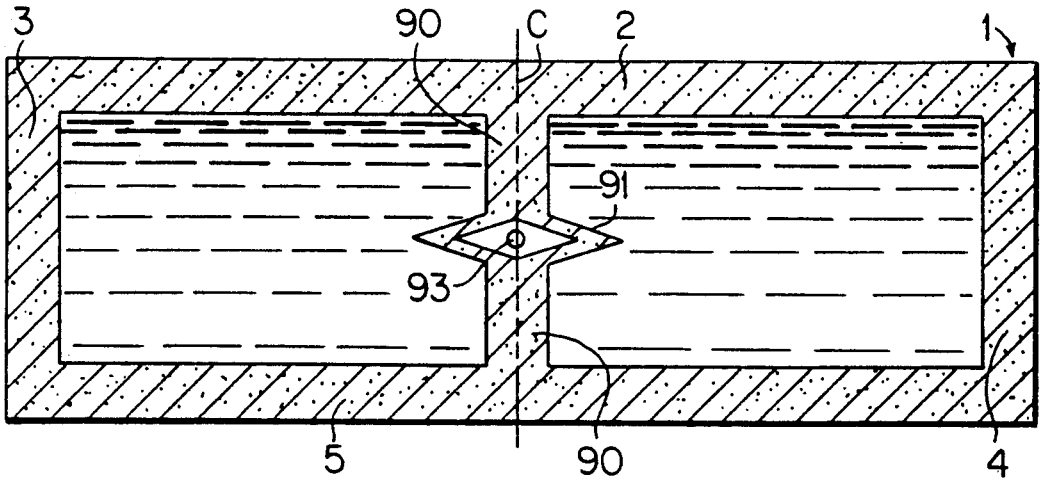
FIG. 9 is a plan cross sectional view which illustrates a further embodiment of the present invention for mixing two types of liquids.
Figure 10:
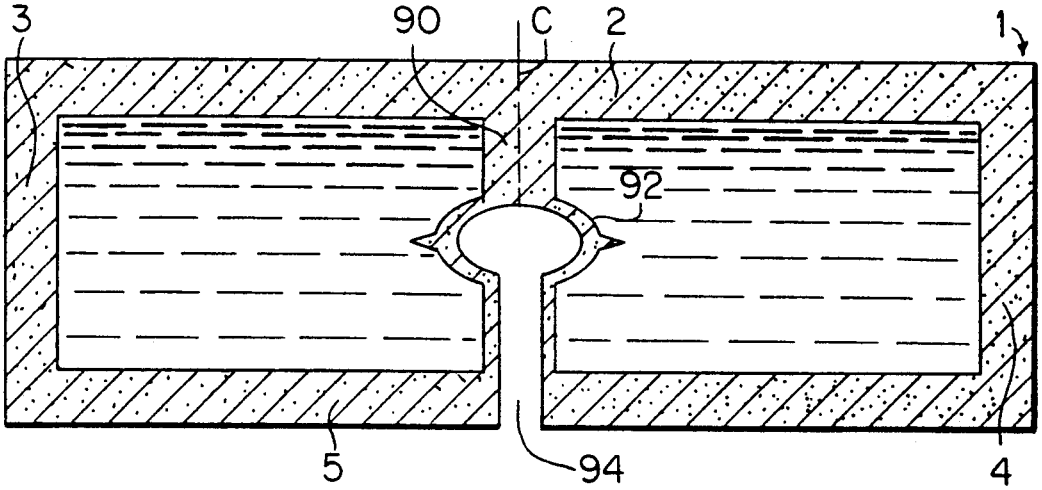
FIG. 10 is a plan cross sectional view which illustrates a further embodiment of the present invention for mixing two types of liquids.

Although each of the above-described embodiments is arranged in such a manner that single liquid is taken out, the present invention may be arranged in such a manner that two types of liquids are enclosed to mix them while taking out them simultaneously. With reference to FIGS. 9 and 10, a sealed seam 90 is formed on the center line C of the container so as to section the container into two portions each of which accommodates different liquids. The tear-up sealed portion 91, 92 may be torn by pressure applied after the container is folded over at the central portion so that the contents may be discharged from ports 93, 94.

As described above, according to the present invention, there is provided a disposable container of a type which uses a material having a heat sealing characteristic and which accommodates a liquid substance before sealing is performed and the contents is taken out by tearing up a sealed portion, the disposable container comprising: a sealed portion having a narrow width and formed into a circular shape, an elliptic shape, or a rhomboid shape or the like in such a manner that its center coincides with the center line of the container which halves the container; and a discharge port formed in the central portion of the sealed portion or a discharge port formed in the central portion of a side from which the content in the sealed portion is desired to be discharged, the discharge port being communicated with an outlet port which has been previously formed in the container.

Therefore, it is preferable to serve as a container for enclosing a liquid condiment, a liquid detergent, liquid cosmetics, liquid medicine or the like before sealing is performed, and the enclosed substance is discharged in such a manner that the container is folded over before pressure is applied to the same by the palm or the fingers of the hand. Furthermore, two kinds of liquids can be accommodated while being insulated from each other and they can be mixed while being simultaneously discharged. In addition, when the container is folded over, the two deceleration chambers overlap to cause the applied pressures to act on each other. Therefore, the rapid flying out of the content is prevented.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A disposable dispenser for liquids comprising:

a container having a sealed perimeter forming a cavity for holding a liquid, said container being foldable so as to divide said cavity into two compartments that can be folded one atop the other;

a chamber inside said cavity having sealed sides projecting into each of said two compartments, said sealed sides having a narrow width for facilitating the rupture thereof when pressure is applied to said container; and a discharge port providing an opening for dispensing liquid from said chamber's interior to outside said sealed perimeter, whereby liquid in said cavity is dispensed from said discharge port when said container is folded onto itself and pressure applied to the container to rupture said sealed sides of said chamber.

2. The dispenser of claim 1 wherein said two compartments are separated by a sealed seam.

3. The dispenser of claim 1 wherein said projecting sealed sides are inverted U-shaped.

4. The dispenser of claim 1 wherein said projecting sealed sides are inverted V-shaped.

5. A liquid dispenser comprising:

two abutting compartments for holding liquid that can be folded one atop the other about a fold line;

a chamber between said two compartments, the chamber having sealed sides that project into said two compartments, said sealed sides being unsealed when said two compartments are folded one atop the other about said fold line and pressure is applied by hand to said two compartments allowing liquid from said two compartments to enter said chamber; and a discharge port from said chamber for allowing liquid to be dispensed from said dispenser.

6. The dispenser of claim 5 further comprising a passageway between said two compartments.

* * * * *